US006110040A

United States Patent [19]

Sanduski et al.

[11] Patent Number: 6,110,040

[45] Date of Patent: Aug. 29, 2000

[54] VIDEO POKER MACHINE WITH REVEALED SIXTH CARD

[75] Inventors: Thomas J. Sanduski; Robert J. Piechowiak, both of Las Vegas, Nev.

[73] Assignee: Sigma Game Inc., Las Vegas, Nev.

[21] Appl. No.: 09/031,123

[22] Filed: Feb. 26, 1998

[51] Int. Cl.[7] ..... A63F 1/00

[52] U.S. Cl. ..... 463/13; 273/292

[58] Field of Search ..... 463/13, 12, 11, 463/16, 20; 273/292, 274

[56] References Cited

U.S. PATENT DOCUMENTS

| | | | |
|---|---|---|---|
| 4,743,022 | 5/1988 | Wood | 463/13 |
| 5,033,744 | 7/1991 | Bridgeman et al. | 273/85 CP |
| 5,042,818 | 8/1991 | Weingardt | 273/292 |
| 5,100,137 | 3/1992 | Fulton | 273/85 CP |
| 5,255,915 | 10/1993 | Miller | 273/85 CP |
| 5,294,120 | 3/1994 | Schultz | 273/85 CP |
| 5,308,065 | 5/1994 | Bridgeman et al. | 463/13 |
| 5,415,404 | 5/1995 | Joshi et al. | 273/138 |
| 5,489,101 | 2/1996 | Moody | 273/292 |
| 5,511,781 | 4/1996 | Wood et al. | 273/85 CP |
| 5,531,441 | 7/1996 | Dabrowski et al. | 463/12 |
| 5,542,669 | 8/1996 | Charron et al. | 463/13 |
| 5,639,088 | 6/1997 | Schneider et al. | 273/138.2 |
| 5,752,702 | 5/1998 | McDaniel | 273/292 |
| 5,769,422 | 6/1998 | Stromer | 273/274 |
| 5,799,946 | 9/1998 | Groussman | 273/292 |
| 5,845,906 | 12/1998 | Wirth | 273/274 |
| 5,853,325 | 12/1998 | Kadlic | 463/13 |
| 5,990,865 | 11/1999 | Gard | 345/156 |
| 6,002,808 | 12/1999 | Freeman | 382/288 |

OTHER PUBLICATIONS

Sarne's Encyclopedia of Card Games, ©1983 pp. 33–38 and 41.

*Primary Examiner*—Valencia Martin-Wallace
*Assistant Examiner*—John Paradiso
*Attorney, Agent, or Firm*—Skjerven, Morrill, MacPherson, Franklin & Friel, LLP; Brian D. Ogonowsky

[57] ABSTRACT

A video poker gaming machine is described where, after initially dealing five cards to a player, the machine displays a sixth card to replace a discarded card by the player. In one embodiment, the sixth card automatically replaces the left-most discarded card. In another embodiment, the sixth card can replace any of the discarded cards.

22 Claims, 3 Drawing Sheets

VIDEO POKER MACHINE WITH REVEALED SIXTH CARD

FIELD OF THE INVENTION

This invention relates to gaming machines and, in particular, to a video poker gaming machine.

BACKGROUND

Video poker machines used for gaming are well known in the art. Most video poker gaming machines used in casinos implement conventional rules for poker by dealing five cards face up and allowing the player to hold any number of the cards. When the player then presses a draw button, the discarded cards are replaced with new cards. A payout table cross-references the resulting hand with a win amount, and the player is paid accordingly.

What is needed is a video poker gaming machine which has more appeal than the conventional video poker gaming machines so that such a machine will be played more often to generate more revenue to the casino, resulting in increased sales of such a video poker machine.

SUMMARY

In one embodiment of a video poker machine in accordance with the present invention, five cards are electrically dealt face up and shown to the player on a CRT screen or other display. Unlike conventional video poker machines where the top card on the deck is not revealed to the player, the present invention reveals this top card to the player. This top card may then be used by the player to replace the first card discarded for that hand. In one embodiment, the first card discarded is the leftmost card discarded. In another embodiment, the revealed sixth card may be used to replace any discarded card.

Such an advantage given to the player results in greater player interest and increased play of the video poker machine.

DETAILED DESCRIPTION OF THE EMBODIMENTS

Figure 1:
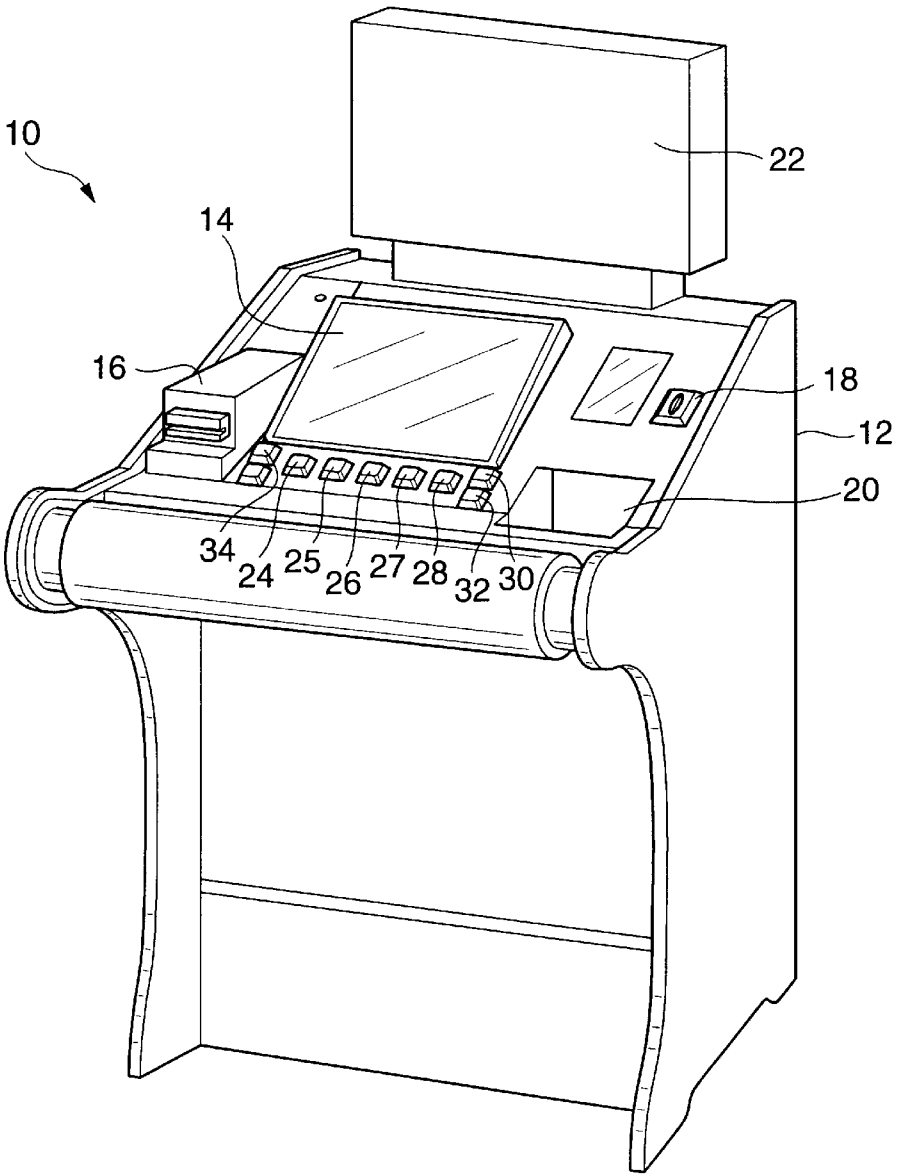
FIG. 1 illustrates a slant-top video poker machine incorporating the present invention.

FIG. 1 illustrates one of the many embodiments of a video poker gaming machine which incorporates the present invention. The particular machine shown in FIG. 1 is a slant-top video gaming machine 10 at which the user may sit and play the machine for extended periods. Gaming machine 10 consists primarily of a housing 12, a CRT screen 14 or other display device, a bill verifier 16, a coin input 18, a payout tray 20, display glass 22 identifying the payouts for various hands and other information, hold buttons 24–28 for holding particular cards, a draw button 30, a bet button 32, and a deal button 34.

The outer design of the gaming machine 10 and the control inputs are conventional. Further, the electronic hardware used to implement the present invention is also conventional. The difference between a present invention and conventional video poker gaming machines resides in the program memory, which is accessed by a processor and is used to run the game. Such circuitry will be described later with respect to FIG. 3.

Various patents, incorporated herein by reference, describing video poker gaming machines are cited below to illustrate the level of skill in the art and to illustrate that an adequate disclosure of a software modification to existing video poker gaming machines may consist of describing the high level operation of the machine rather than circuitry details of a conventional design. These patents include U.S. Pat. Nos. 5,542,669; 5,531,441; 5,511,781; 5,100,137; and 5,033,744. Such patents also illustrate the crowded field of video poker gaming machines.

Figure 2:
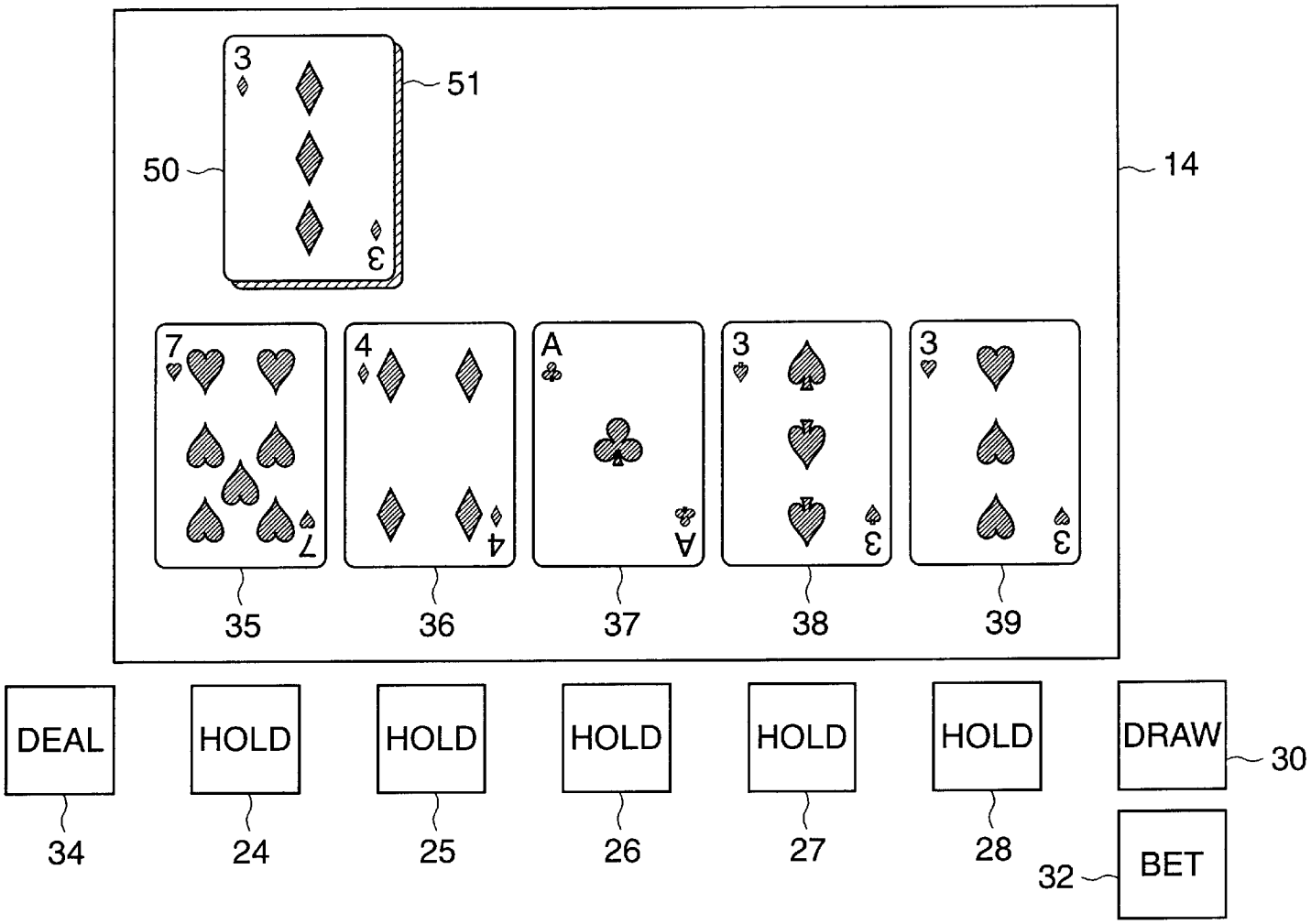
FIG. 2 shows one example of the cards dealt at the initiation of a hand as well as the revealed sixth card.

FIG. 2 illustrates one example of the display on CRT screen 14 after a particular poker hand has been electronically dealt to the player. The playing of a game will be described with reference to FIGS. 2, 3, and 4.

To begin a game, the player inserts coins or bills into the gaming machine 10. The player then places a bet by depressing button 32 a desired number of times. A game is now initiated, shown as step 1 of FIG. 4.

Figure 4:
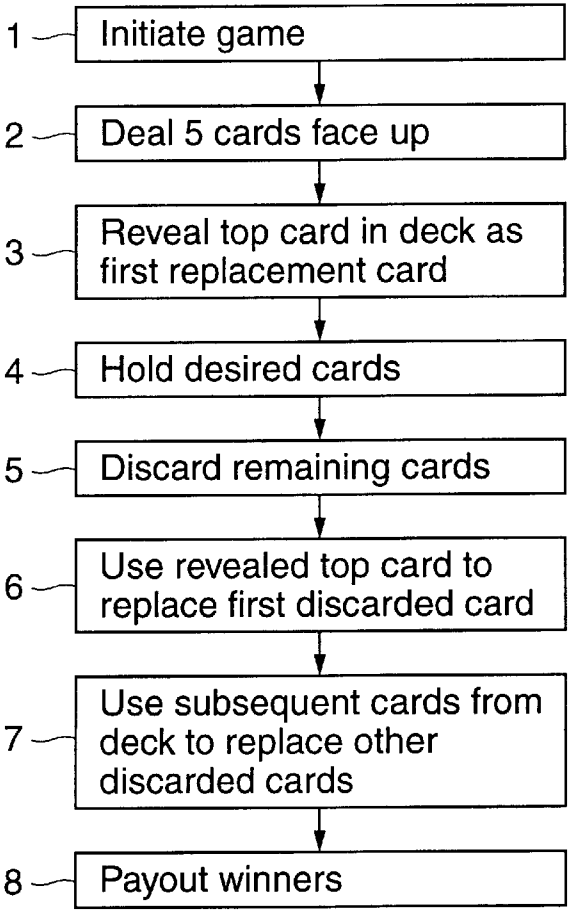
FIG. 4 is a flowchart illustrating the basic steps which may be used in the present invention.

The player then presses the deal button 34 to cause the machine 10 to deal five cards 35, 36, 37, 38, 39 face up, shown as step 2 of FIG. 4. The various buttons and other inputs illustrated in FIG. 1 are termed control inputs 40 in FIG. 3.

A processor 42 receives instructions from a program memory 44 for carrying out the play of the game. The hardware illustrated in FIG. 3 may be conventional, with the difference between the prior art and the present invention being the software code incorporated into program memory 44. Program memory 44 may be a ROM or other memory device external to or part of processor 42. The selection of cards from a fifty-two card deck is made using a random number generator 46 of conventional design. The random number generator 46 may be included in program memory 44. Thus, the five cards 35–39 displayed on CRT screen 14 are dealt at random to emulate an actual poker game.

The random number generator 46 also identifies a revealed sixth card 50, which is intended to illustrate the top card on the deck 51 of remaining cards. This revealed sixth card 50 will be the first card dealt to the player to replace one of the player's discarded cards. The revelation of this top card is shown as step 3 in FIG. 4.

Figure 3:
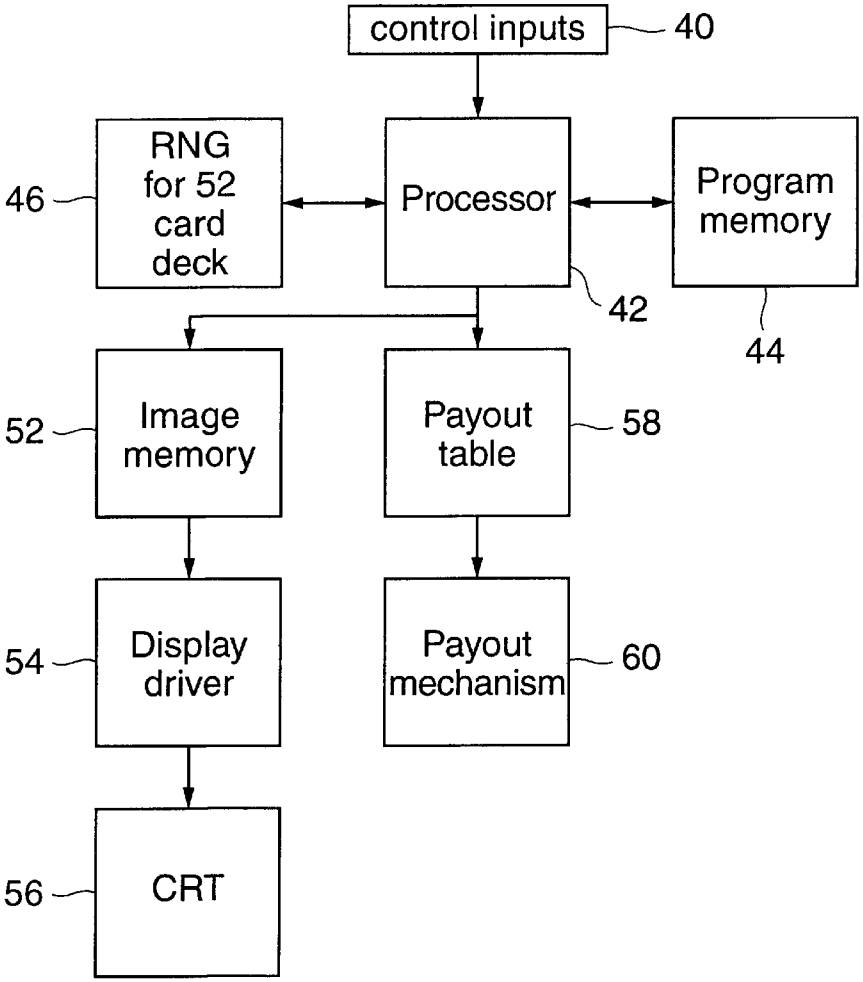
FIG. 3 illustrates the relevant functional blocks which may be used to implement the present invention.

The display of the cards on screen 14 is performed in a conventional manner. A code generated by processor 42 in FIG. 3 is converted into the relatively complex pixel pattern of a card by an image memory 52. Image memory 52 may be conventional and identifies the illumination levels of the various pixels on CRT screen 14 to create the image displayed to the player.

A display driver 54 converts the output of image memory 52 into electrical signals for the CRT 56.

In the next step of the game, the player pushes any combination of the hold buttons 24–28 to hold one or more of the five initially dealt cards, shown as step 4 in FIG. 4.

The player then presses the draw button 30 to discard the cards which were not held, shown as step 5.

In one embodiment, the revealed sixth card 50 replaces the leftmost discarded card, shown as step 6 in FIG. 4. In the example illustrated in FIG. 2, the player will most likely hold the pair of threes since the player knows that the first replacement card for any of the discarded cards will be another three, giving the player three-of-a-kind.

In other embodiments, the revealed sixth card 50 may replace discarded cards in other card positions. Such other positions may include the rightmost discarded card. Machine 10 may even randomly select prior to a game whether the revealed sixth card 50 will replace the leftmost or rightmost discarded card.

In one embodiment, the gaming machine 10 pays an extra amount upon a sequential straight or straight flush being displayed. In that embodiment, the machine 10 determines which discarded card position can best use the revealed sixth card to obtain the highest win amount. That particular discarded card is then replaced with the revealed sixth card 50. This technique may be used for any hand in which the order of cards is relevant.

In another embodiment, the player is given the option of selecting the discarded card to be replaced with the revealed sixth card. This selection may be made by providing the machine 10 with one or more control buttons for selecting the discarded card to be replaced with the revealed sixth card 50.

The remainder of the cards discarded in step 5 will be replaced by other cards from the deck, randomly selected by the random number generator 46, shown as step 7 of FIG. 4.

At this time, the player's final hand is now displayed at the bottom of the CRT screen 14 and a payout, if appropriate, is then awarded. Referring to FIG. 3, the processor keeps track of the player's hand, and the displayed combination is applied to a payout table 58, which cross-references the combination of cards to a player's winnings. A payout signal is then applied to a conventional payout mechanism 60 for paying out the appropriate number of tokens or by crediting the player, shown as step 8 of FIG. 4.

The resulting video gaming machine thus provides the player an advantage in that the player has a better idea of which cards to discard by knowing the first card to be drawn from the deck. This generates increased player interest, resulting in increased revenue to the casino and increased sales of the machine.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A video poker gaming machine comprising:

a display device;

a program memory containing a video poker game program;

processing circuitry connected to receive a code stored in said program memory to carry out said game program;

display circuitry connected to said processing circuitry for generating an image on said display device;

said program memory containing instructions for carrying out the following method performed by said video poker gaming machine:

electronically dealing a player five cards face up, whereby said five cards are displayed to said player on said display device;

revealing a sixth card, face up, to said player;

discarding at least one card identified by said player;

replacing a discarded card with said sixth card;

replacing additional discarded cards, if any, with cards not previously revealed to said player; and causing a winning poker hand to pay out winnings to said player.

2. The machine of claim 1 wherein said step of replacing a discarded card with said sixth card comprises replacing a leftmost discarded card with said sixth card.

3. The machine of claim 1 wherein said step of replacing a discarded card with said sixth card comprises replacing a rightmost discarded card with said sixth card.

4. The machine of claim 1 wherein an order of cards within certain poker hands affects a payout to a player, and wherein said machine determines which discarded card to replace with said sixth card such that said order of cards is optimum for said player.

5. The machine of claim 4 wherein said certain poker hands comprise a sequential straight.

6. The machine of claim 5 wherein said sequential straight is a sequential straight flush.

7. The machine of claim 4 wherein said certain poker hands comprise a flush with cards in a particular order.

8. The machine of claim 1 wherein an order of cards within certain poker hands affects a payout to a player, and wherein said player determines which discarded card to replace with said sixth card.

9. The machine of claim 8 wherein said certain poker hands comprise a sequential straight.

10. The machine of claim 9 wherein said sequential straight is a sequential straight flush.

11. The machine of claim 8 wherein said certain poker hands comprise a flush with cards in a particular order.

12. A method performed by a video poker gaming machine comprising:

electronically dealing a player five cards face up, whereby said five cards are displayed to said player on said display device;

revealing a sixth card, face up, to said player;

discarding at least one card identified by said player;

replacing a discarded card with said sixth card;

replacing additional discarded cards, if any, with cards not previously revealed to said player; and causing a winning poker hand to pay out winnings to said player.

13. The method of claim 12 wherein said step of replacing a discarded card with said sixth card comprises replacing a leftmost discarded card with said sixth card.

14. The method of claim 12 wherein said step of replacing a discarded card with said sixth card comprises replacing a rightmost discarded card with said sixth card.

15. The method of claim 12 wherein an order of cards within certain poker hands affects a payout to a player, and wherein said machine determines which discarded card to replace with said sixth card such that said order of cards is optimum for said player.

16. The method of claim 15 wherein said certain poker hands comprise a sequential straight.

17. The method of claim 16 wherein said sequential straight is a sequential straight flush.

18. The method of claim 15 wherein said certain poker hands comprise a flush with cards in a particular order.

19. The method of claim 12 wherein an order of cards within certain poker hands affects a payout to a player, and wherein said player determines which discarded card to replace with said sixth card.

20. The method of claim 19 wherein said certain poker hands comprise a sequential straight.

21. The method of claim 20 wherein said sequential straight is a sequential straight flush.

22. The method of claim 19 wherein said certain poker hands comprise a flush with cards in a particular order.

* * * * *